United States Patent [19]

Mouton

[11] 4,382,742

[45] May 10, 1983

[54] ATHLETIC DISCUS RETRIEVER

[76] Inventor: Ralph O. Mouton, 705 Jefferson St., Lafayette, La. 70502

[21] Appl. No.: 303,110

[22] Filed: Sep. 17, 1981

[51] Int. Cl.[3] ..... B60P 1/36

[52] U.S. Cl. ..... 414/439; 294/19 A

[58] Field of Search ..... 294/19 A, 19 R, 50.6, 294/50.8, 50.9; 56/328, 329, 332, 333, 400.11, 400.12; 280/411 R, 481, 8, 12 R, 47.24, 47.26, 63; 414/440, 439

[56] References Cited

U.S. PATENT DOCUMENTS

| | | | |
|---|---|---|---|
| 326,016 | 9/1885 | Burt | 414/440 |
| 2,484,437 | 10/1949 | Wells | 294/19 A |
| 3,717,371 | 2/1973 | Halone | 294/19 A |

*Primary Examiner*—James B. Marbert

*Attorney, Agent, or Firm*—Harvey B. Jacobson

[57] ABSTRACT

Athletic discus retriever for lifting a discus from the ground surface and projecting it toward a retrieval area including a vehicle or cart having a set of inclined support members extending between a novel work surface and handles. The work surface includes discus erecting members or guide surfaces so that after the discus is scooped up when moving the cart forward and retrieving the discus in a flat position on the work surface, by then tilting the cart handles down and rearwardly the discus will fall along the guide surfaces so that when the discus responds to the force of gravity, the discus is guided to a vertical position resting upon its edge. The cart is provided with a spring and release mechanism which upon proper operation projects the discus toward a retrieval area adjacent a discus court by rolling it along the ground surface.

13 Claims, 4 Drawing Figures

ATHLETIC DISCUS RETRIEVER

BACKGROUND OF THE INVENTION

The present invention relates to a discus retriever apparatus constructed of essentially light metal or plastic materials having handles for steadying and handling of the retriever or cart and having a work surface with guide surfaces so that when a discus is picked up, it will be tilted to an upright position when the retriever apparatus is tilted rearwardly. More particularly the retriever includes a spring mechanism and release member, so that by cocking the spring mechanism and then releasing it, the discus is projected in its vertical orientation toward a retrieval or collection area.

FIELD OF THE INVENTION

Discus throwing and discus practice throwing has been a sport for many years. Consistently over the years, after the discus has been thrown, the discus is usually picked up by hand and thrown toward a retrieval or collection area off of the discus court and away from the discus court so that discuses are collected and made again available to the performer or player. All of this gives rise to the disadvantage that discuses, when being thrown to the retrieval area, land upon the edge in such a way that they roll in undesired directions and to remote areas.

DESCRIPTION OF THE PRIOR ART

Although the art of discus throwing and manual recovery thereof seems old in the sports world there are no presently known prior art arrangements or devices for accomplishing results proximate to those of the present invention. Various patents on carts and their construction are known and the following are exemplary:

| | | |
|---|---|---|
| U.S. Pat. No. 2,037,222 | Farrar | April 14, 1936 |
| U.S. Pat. No. 2,852,304 | Harrison | September 16, 1958 |
| U.S. Pat. No. 2,895,238 | Long | July 21, 1959 |
| U.S. Pat. No. 3,043,033 | Ingram et al | July 10, 1962 |
| U.S. Pat No. 3,046,031 | Reynolds | July 24, 1962 |
| U.S. Pat. No. 4,252,334 | Filkins | February 24, 1981 |

The above patents provide for no more than carts having a capability of dumping loads being carried by pivoting a load carrying body in relation to the wheel and axle assembly. Further, none of these patents disclose a cart capable of retrieving and uprighting a discus and for then supporting it for ejection when the discus has been transported to a desired location. Further, the patents do not disclose a spring tensioning and release mechanism providing for ejection of the discus to a given area for retrieval.

SUMMARY OF THE INVENTION

It is an object and advantage of the present invention to provide a cart having a guide means together with spring tensioning and controlled release mechanisms so that after a discus is picked up, the discus is positioned according to guide members on the cart and after being rolled to a given location, if desired, the spring release mechanism is actuated for directing the discus along a straight path to a given collection area.

More particularly the invention has as an object, advantage and feature to provide a cart for collecting discuses, arranging or erecting them into an upright position and then impelling or projecting the discus along a given path that is easily predetermined by means of the position of the discus cart and actuation of the spring release mechanism thereof.

Another object and advantage of the invention is to provide a discus retriever constructed of essentially light metal, easy to construct and repair, simple in construction, cost effective and efficient in handling the retrieval of discuses having been thrown on a discus court so that upon retrieval, the discuses are selectively directed along a determined trajectory to a discus retrieval area.

Also an advantage, feature and object of the present invention is to provide a device that overcomes the disadvantage and danger incumbent upon present practice of hand pickup of the discus and having it then thrown to an off-court discus retrieval area where it lands in various and random positions resulting in the discus rolling in any of several directions. By means of the present invention it is seen that the retriever apparatus thereof provides for ease in handling and rolling of the discus to a point where it can be safely retrieved for further practice and use.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
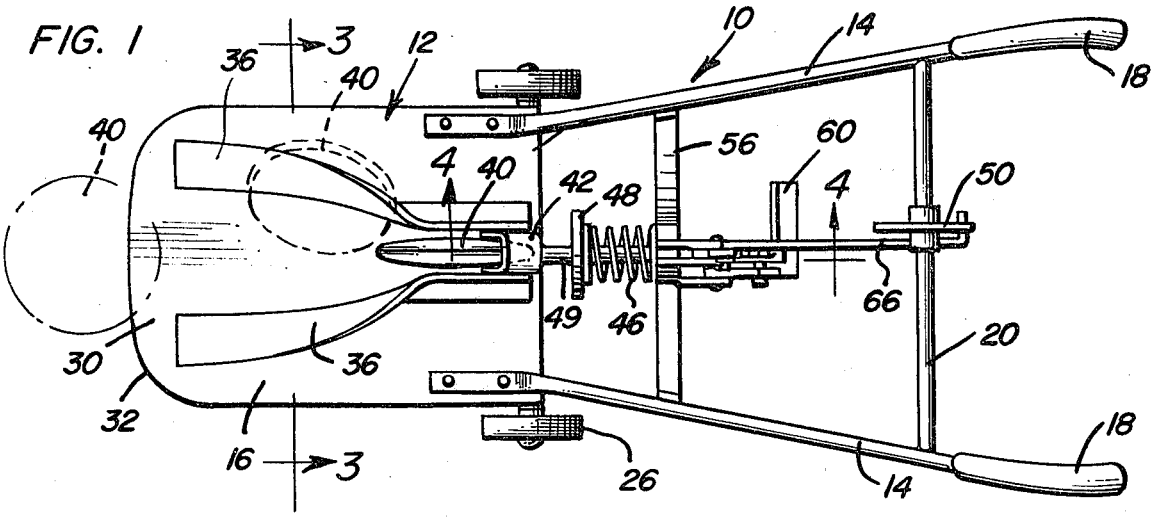
FIG. 1 is a top plan view of one embodiment of the present invention according to a best mode and its preferred embodiment.

Referring now to the drawing there is shown an athletic discus retriever apparatus 10 consisting of a vehicle or cart 12 which includes a set of inclined support members 14, 14 that extend from a base or work surface 16 in a diverging relation upwardly and rearwardly to handles 18, 18. Brackets, crossbars or support members 20, 20 are provided between the inclined support members 14, 14. On the base of the cart and extending to each side of the work surface 16 there is an axle 24 having wheels 26 mounted in conventional fashion at each end thereof.

Figure 3:
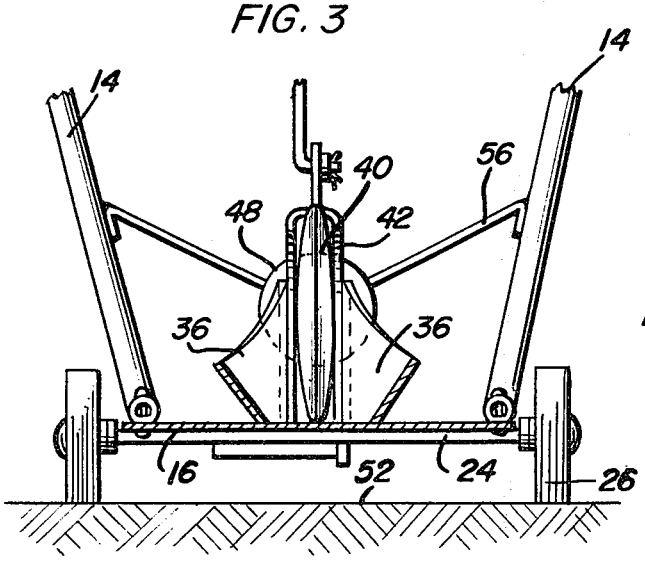
FIG. 3 is a sectional view taken along section line 3—3 on FIG. 1.
Figure 4:
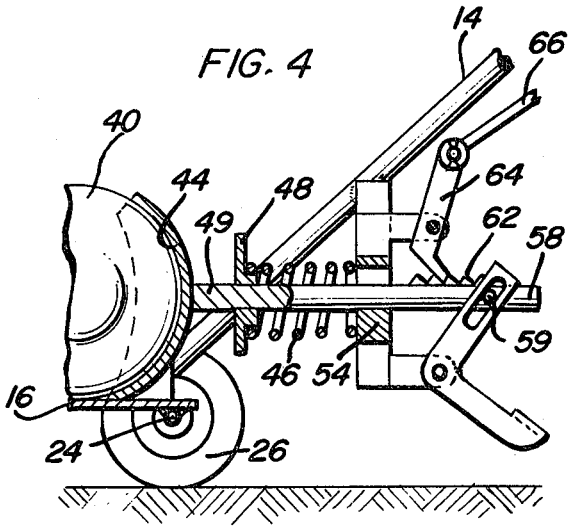
FIG. 4 is a sectional view, on an enlarged scale, taken along section line 4—4 on FIG. 1.

A forward edge of the base or work surface 16 includes a scoop-like surface 30 and it may be contoured as shown from a plan or vertical view to have a rounded contour 32 extending throughout the entire front edge of the base or work surface 16. Thus, if the cart is tilted slightly forward about the wheels 26, the scoop surface 30 readily engages under a discus 40 to be collected, and with forward movement of the cart, together with a gentle rearward tilting of the cart, the discus is retrieved onto the work surface. By further tilting of the cart about the wheels 26 so that handles 18 are essentially lowered somewhat, the discus will ride upon guide surfaces 36, 36 shown in FIGS. 1–3 so that the discus is caused to move rearwardly and tilt into an upright position.

The edge of the discus 40 is received within a rubber covered, arcuate or horseshoe shaped, vertically disposed, horizontally movable trough or bracket 42 such that the discus 40 may have a portion of its rear peripheral edge disposed within the bracket 42 so that it is maintained in a vertical relation or position as shown. Inside of the bracket 42 there is an arcuate projection surface 44 for engaging the lip or edge periphery of the discus 40 so that upon release of a spring mechanism 46, member 44 is driven rapidly forward projecting the discus 40 into an upright target path. If the cart is directed toward a discus recovery or retrieval area adjacent the discus court, it is seen that the discus 40 is readily collected directly at the discus recovery area without the discus going through phases of wobble, circular paths of trajectory or the like during retrieval. The time used in collecting discuses is shortened so that the discus or discuses may be readily reused for practice and playing purposes.

The spring member 46 has a plunger 48 so that when it is released from a cocked position shown in FIG. 1, the mechanism 44 ejects the discus 40 into its trajectory path as is described above and shown in FIG. 2. Means for releasing the spring mechanism 46 from a cocked position is by use of the hand release mechanism 50 and the spring mechanism is manually reset by physically again compressing the spring mechanism 46 by moving the bracket 42 to its rearmost position. By reset of the spring mechanism 46, it is again available for collection of a discus and for directing it through a trajectory path to the discus collecting area.

Figure 2:
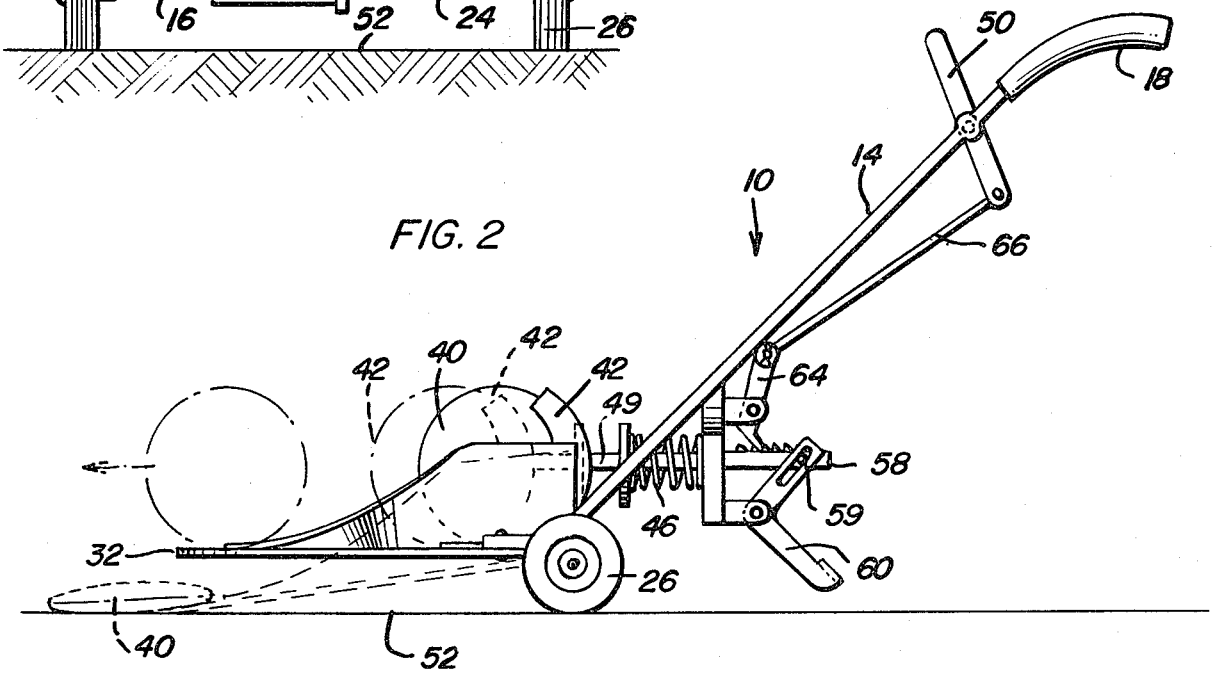
FIG. 2 is a side elevational view thereof.

The work surface 16 is essentially a planar platform with a rounded front edge 32 with the size of the wheels 26 and location of the axle 24 being such that the rounded front edge 32 may be easily lowered to a position closely adjacent the ground surface 52 and positioned under the peripheral edge of the discus which is lying flat on the ground surface as shown in FIG. 2. Then by rapidly accelerating the cart 10 forwardly, the discus 40 will slide onto the inclined platform 16 and be retained thereon as the platform is moved back to a generally horizontal position and to a forwardly and upwardly inclined position as the cart is stopped. In order to orient the discus so that it rests on its edge, the rear of the platform 16 is lowered and the horizontal discus 40 will slide rearwardly and as it engages the inclined and inwardly curved guide surfaces 36, the discus will be tilted to vertical or upright position. It may be necessary to vertically oscillate the handles 18 to facilitate rearward movement of the discus 40 and to make certain that the lower edge portion of the discus stays in contact with the platform 16. The portions of the guide surfaces 36 adjacent the rear of the platform are substantially vertical with the space therebetween being only slightly greater than the thickness of the discus 40 at the center thereby coacting with the trough or bracket 42 which is centered between the rear edges of the guide surfaces 36 to maintain the discus in vertical position as the cart is manuevered to a desired position to eject the discus toward the retrieval area. The guide surface 36 may be rigidly affixed to the platform as shown or they may be laterally adjustable a small amount to compensate for differences in thickness of a discus used in high school competition as compared to one used in college or olympic competition.

The plunger 48 is provided with a rod 49 rigidly connected to the trough or bracket 42 so that the trough 42 can move forwardly between the guide surfaces or plates 36 to eject the discus 40 while in vertical position. The spring 46 is interposed between the plunger 48 and a stationary plate 54 fixedly attached to the support members 14 by brackets 56. A guide rod 58 rigidly affixed to the plunger 48 extends centrally through the spring 46 and slidably through an aperture in the plate 54 to stabilize the plunger and spring with the guide rod 58 forming a continuation of the rod 49 with the forward end of the rod 49 being supported by the trough 42 engaging the top surface of the platform 16. A foot pedal 60 is pivotally supported on the plate 54 and has its upper end connected to the rear end of rod 58 by a slot and pin connection 59 to enable the rod 58 to be moved rearwardly in a straight line path thus compressing spring 46 to a cocked position and moving the trough back to a position between the rearmost edges of the guide members 36. The rod 58 has teeth or notches 62 in one side thereof to be engaged by a pivotal latch member 64 mounted on plate 54 and connected with actuating rod 66 extending to and connected with pivotal spring biased handle or lever 50 connected to a crossbar 20 between the upper ends of members 14. This enables the rod 58 to ratchet past the latch 64 when moving rearwardly and the latch will retain the spring plunger and trough 42 in retracted or cocked position while the discus is being picked up and the cart maneuvered to desired position in order to aim the discus toward the retrieval area. The handle or lever 50 may then be activated to release latch 64 so that the spring can rapidly expand thus rolling the discuss toward the retrieval area. The foot pedal 60 can then be actuated to recock the spring so that the cart is conditioned to pick up the next discus thrown by a competitor in a track meet or the like.

It is seen that by use of the present invention, security, safety and effectiveness in collection of discuses is accomplished.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An athletic discus retriever including an inclined set of support members having a wheel at one end of each member and a set of handles at the other end of each member, a work surface extending between the wheels and fixedly secured in place by the inclined set of support members, means mounted upon the work surface guiding a discus from a retrieved flat laying position rearwardly upon the work surface as the retriever is tilted rearwardly, so that the discus is guided to a vertical position resting upon its edge, and spring means having a discus engaging means for projecting upon release of the discus from its edge resting position.

2. The invention of claim 1 wherein bracket members hold the inclined set of support members in diverging relation away from the work surface and toward the handles.

3. An athletic discus retriever for picking up a discus lying flat on the ground surface and rolling it on edge toward a retrieval area away from the discus throwing area and the landing area of a discus court, said retriever comprising a platform having a forward edge contoured to fit under the peripheral edge of a discus lying on the ground surface with the peripheral edge spaced therefrom, wheel means supporting the platform to enable fore and aft rocking motion to enable the forward edge to be positioned under the edge of the discus, handle means operatively associated with the platform to tilt and maneuver the platform, guide means on the platform to tilt the discus to a generally upright vertical position as the discus is moved rearwardly with respect to the platform during rearward tilting of the platform after the discus has been picked up from the ground surface during a rapid forward scooping movement of the platform and means operatively associated with said platform to eject the discus from the platform while in upright position for rolling the discus on the ground surface toward a retrieval area.

4. The structure as defined in claim 3 wherein said platform is provided with a generally planar upper surface, said wheel means includes a pair of laterally spaced wheels oriented substantially rearwardly of the forward edge of the platform to form a fulcrum for forward and rearward tilting of the platform.

5. The structure as defined in claim 3 wherein said guide means includes a pair of laterally spaced guide plates having generally horizontal forward edges attached to the platform in laterally spaced relation adjacent the forward edge thereof and curving upwardly and rearwardly to generally parallel vertical rear portions spaced apart a distance only slightly greater than the thickness of a discus to cause the discus to tilt to vertical upright position when it moves toward the rear of the platform.

6. The structure as defined in claim 5 wherein said means for ejecting the discus includes an arcuate trough extending vertically between the rear portions of said guide plates and engaging a portion of the rear edge of the discus when the discus is in its rearmost position and the trough is in retracted position, and spring means operatively associated with said trough to spring bias it towards a forward extended position, means to retract said trough while tensioning the spring means, latch means to retain the trough in retracted position and means to operate said latch means to release the spring means and trough whereby the trough will be moved rapidly forwardly to eject the discus in upright position thereby rolling the discus on edge.

7. The structure as defined in claim 6 wherein said trough retracting means and said latch operating means are manually operated.

8. The structure as defined in claim 3 wherein said means to eject the discus includes an ejector engaging the rear edge portion of a discus and means for moving the ejector rapidly forwardly after the retriever has been positioned in desired orientation to roll the discus along the ground surface.

9. An athletic discus retriever including a base defining a horizontally opening scoop and equipped with ground engageable support means therefore for support from and manual guided forward movement over a ground surface, said scoop including forwardly facing transverse front edge means capable of being advanced beneath a discus lying in horizontal position upon the ground and guide and support means rearward of said front edge means for engaging and turning a horizontal discus, relative to which said base is being forwardly advanced, approximately 90° to an edge upstanding position preparatory to forward rolling of said discus relative to said base from the latter, said guide and support means including discus edge engaging means for limiting rearward movement of said discus in edge upstanding position relative to said base and supported from the latter for guided movement between forward and rearward limit positions toward and away from said front edge means, and means operatively connected between said edge engaging means and said base for rapidly forwardly displacing said edge engaging means toward said forward limit position.

10. The retriever of cliam 9 wherein said means operatively connected between said frame and edge engaging means includes spring means and manually operable latch means operably connected between said base and edge engaging means releasably latching said edge engaging means in said rearward limit position.

11. The retriever of claim 9 wherein said ground engageable support means includes opposite side wheel means carried by said frame rearward of said front edge means.

12. The retriever of claim 11 wherein said frame includes rearwardly and upwardly inclined handle means.

13. The retriever of claim 12 wherein said means operatively connected between said frame and edge engaging means includes spring means and manually operable latch means operably connected between said base and edge engaging means releasably latching said edge engaging means in said rearward limit position, said latch means including an operator therefore supported from said handle means.

* * * * *